United States Patent [19]

Black, Jr. et al.

[11] Patent Number: 5,011,299

[45] Date of Patent: Apr. 30, 1991

[54] BAG CONSTRUCTION

[75] Inventors: Richard A. Black, Jr., Bensalem; Gilbert N. Yannuzzi, Jr., Richboro, both of Pa.

[73] Assignee: American Packaging Corporation, Philadelphia, Pa.

[21] Appl. No.: 481,858

[22] Filed: Feb. 20, 1990

[51] Int. Cl.[5] ..... B65D 30/18

[52] U.S. Cl. ..... 383/126; 219/10.55 E; 426/107; 426/113; 383/103

[58] Field of Search ..... 383/103, 126; 219/10.55 E; 426/107, 113

[56] References Cited

U.S. PATENT DOCUMENTS

| | | | |
|---|---|---|---|
| 2,846,928 | 8/1958 | Kardon et al. | 493/206 |
| 2,865,768 | 12/1958 | Barnes et al. | 383/103 |
| 3,342,402 | 9/1967 | Kardon | 383/40 |
| 4,490,131 | 12/1984 | Coleman et al. | 493/217 |
| 4,765,999 | 8/1988 | Winter | 426/113 |
| 4,904,487 | 2/1990 | LaBaw et al. | 426/107 |
| 4,904,488 | 2/1990 | LaBaw et al. | 426/107 |

*Primary Examiner*—Stephen P. Garbe
*Attorney, Agent, or Firm*—Frank A. Follmer

[57] ABSTRACT

A bag of the gusseted square-bottom type having a generally rectangular bottom including a rectangular bottom fold portion and a triangular bottom fold portion is made with the triangular fold portion overlapping the rectangular fold portion. The triangular fold portion is sealed at the outermost ends thereof to define an inner enclosed space which communicates with the interior of the bag so that it can be extended from the bag bottom as the bag expands during a microwave cooking operation to form a fin-like extension.

5 Claims, 3 Drawing Sheets

FIG. 5
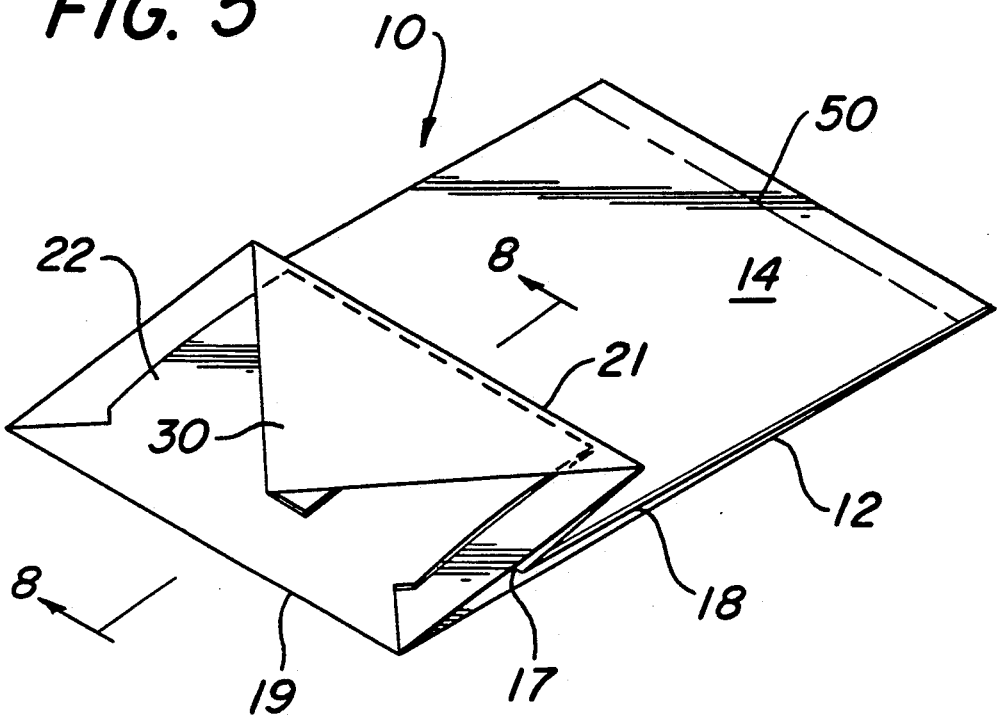
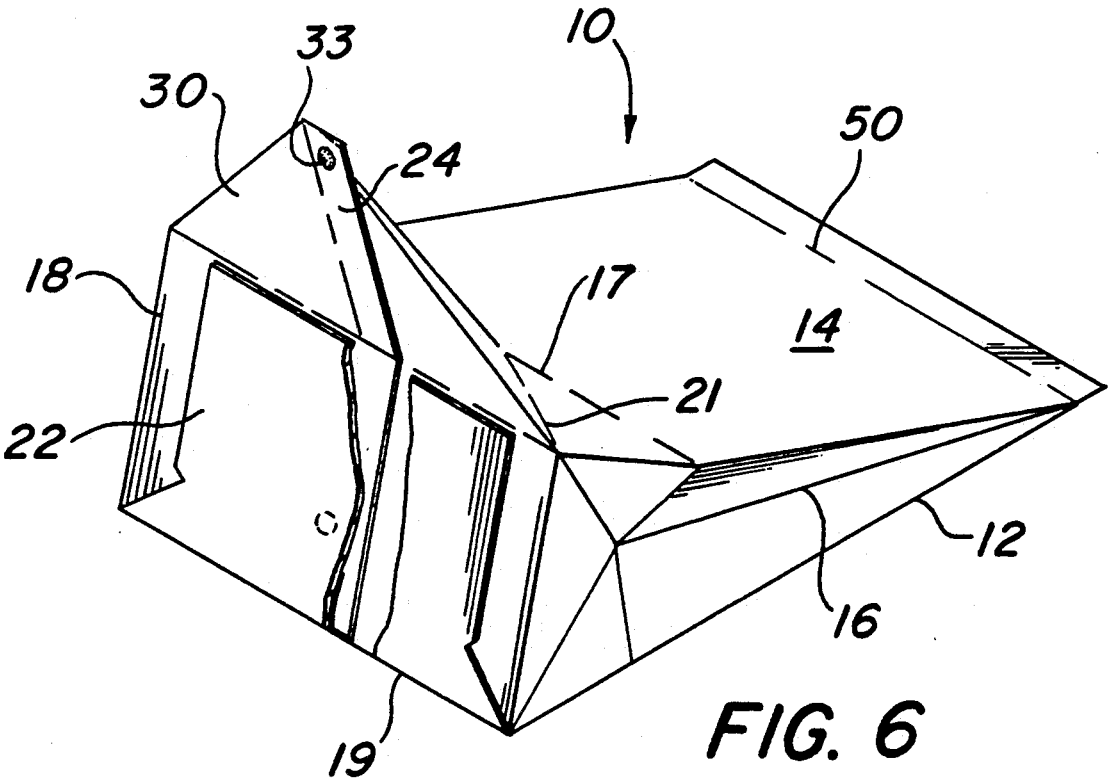
FIG. 6

FIG. 7
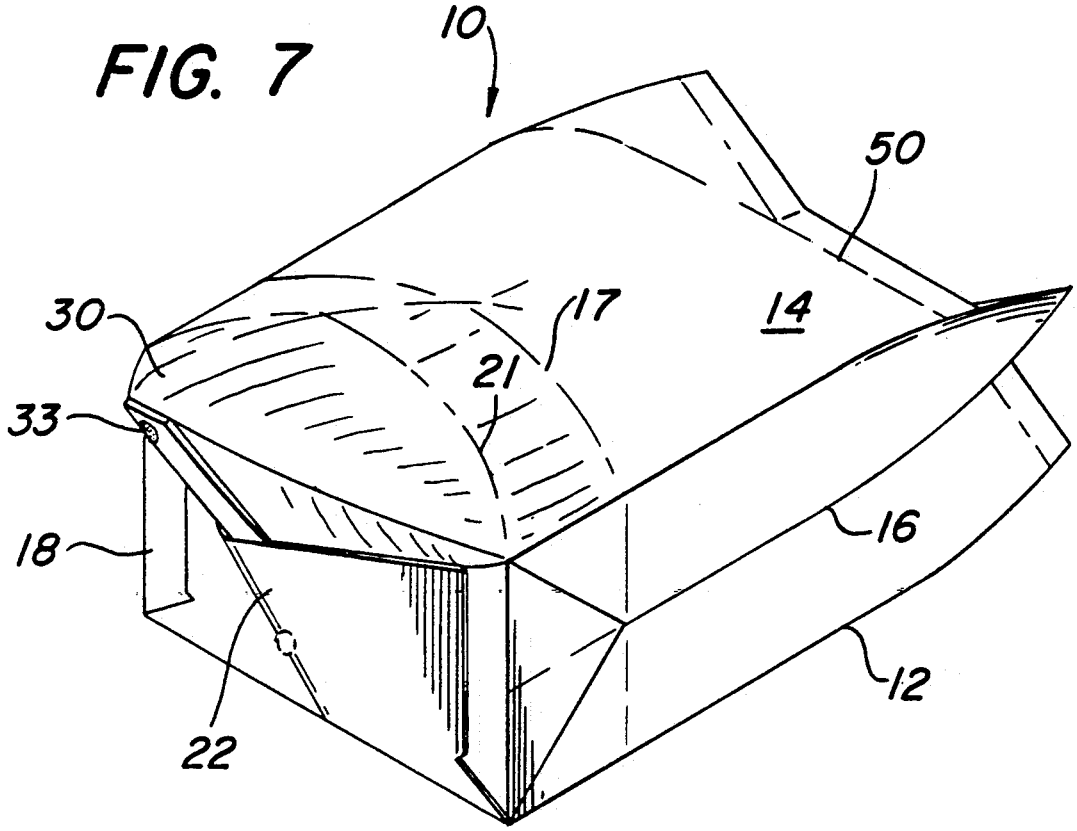
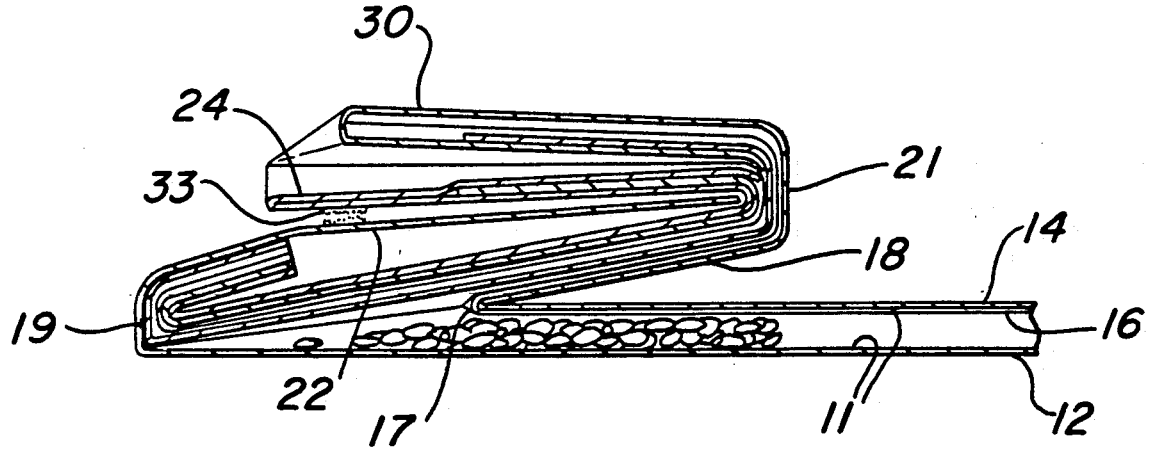
FIG. 8

BAG CONSTRUCTION

BACKGROUND AND SUMMARY OF THE INVENTION

This invention relates to the construction of bags of the gusseted, square-bottom type adapted to be used for the cooking of foods, such as popcorn or the like.

Gusseted square-bottom bags are disclosed in U.S. Pat. Nos. 2,596,796; 3,017,079; 3,342,402; and 4,490,131. As disclosed in these patents, the bags of this type generally comprise an outer sheet of paper and an inner liner of paper or an impervious heat sealable material such as a plastic (synthetic resin). The bag is made of a tube and the bottom end of the bag is formed by making a diamond fold comprising a triangular fold portion and a partly rectangular tab fold portion. After the triangular fold portion and the tab fold portion are sealed, the bottom of the bag is completed by folding over the tab fold portion onto a previously folded over triangular fold portion. The tab fold portion is caused to adhere to the bottom of the bag by applying suitable adhesive between the contiguous faces of the tab fold portion and the triangular fold portion of the bag bottom structure. When a bag of the indicated type is used for microwave cooking, they may be constructed in the manner described in U.S. Pat. No. 4,571,337 by the provision of a suitable coating which improves the microwave cooking operation.

In accordance with the present invention there is provided a bag bottom construction which improves the efficiency of the microwave cooking operation. To this end, and contrary to the conventional bag bottom formation as described above, the triangular fold portion is folded over to overlap the tab fold portion and the contiguous faces of these fold portions are adhered together by an adhesive which is responsive to the occurrence of an elevated temperature (such as would be produced during a microwave cooking operation) to lose at least some of its adhesive properties whereby said triangular fold portion can move away from the bag bottom to break its attachment thereto in response to a force applied thereto causing the same to move in said direction. Such a force would occur during a microwave cooking operation when the gases within the bag expand and flow from the interior of the bag past the fold at the bottom end of the triangular fold portion and into the interior thereof causing the triangular fold portion to straighten up and, therefore, move away from the bag bottom. Typically, the triangular fold portion extends directly away from the bag bottom to the farthest extent possible.

BRIEF DESCRIPTION OF THE DRAWINGS

FIG. 5 is a perspective view showing a bag in accordance with the invention containing a quantity of popcorn kernels and in a condition in preparation for a microwave cooking operation.

FIG. 6 is a view of the bag shown in FIG. 5 showing the bag in a partially expanded condition during an intermediate stage in a microwave cooking operation.

FIG. 7 is a view of the bag shown in FIG. 5 at the end of a microwave cooking operation wherein the bag is fully expanded and the popcorn kernels have been popped.

FIG. 8 is a sectional view taken generally on line 8—8 of FIG. 5 but with the parts of the bag shown in an enlarged and modified condition for clarity of illustration.

DETAILED DESCRIPTION OF THE PREFERRED EMBODIMENT

Figure 1:
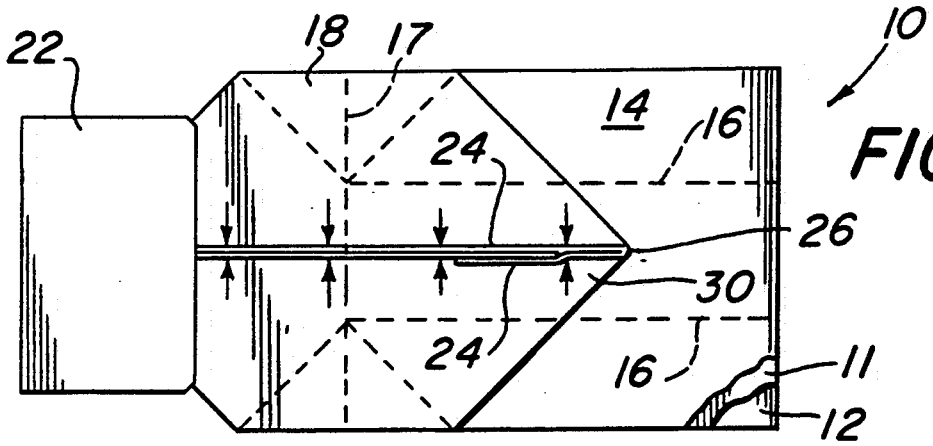
FIGS. 1–4 are plan views showing successive steps in the method of formation of the bottom of a bag in accordance with the invention.

In FIGS. 1–4 there is shown a bag 10 in accordance with the invention comprising a gusseted, square-bottom construction and the successive steps in the method of making the same. The bag 10 is made by a method similar to that described in U.S. Pat. No. 2,496,796, the main difference being that the triangular bottom fold portion of the diamond fold is folded on top of the rectangular bottom fold portion.

Referring to FIGS. 1–4, the bag 10 is formed from a tube having an outer sheet of paper and an inner liner 11 of paper selectively coated with heat sealable material or an impervious heat sealable plastic (synthetic resin) whereby the bag can be sealed in the manner described in said patent. Further, bag 10 is made of an outer sheet and liner suitable for microwave cooking, as is well known in the art. The bag is formed into a bag configuration as shown in the drawings whereby the bag 10 is of the gusseted square-bottom type having rectangular front and back panels 12 and 14, respectively, inwardly folded gusseted side panels 16, and a rectangular bottom 18.

The bag 10 is made from an intucked, flat bag tube which may be made by one of the automatic bag making machines well known in the art. The tube is cut in suitable lengths and the end of the cut tube that is to form the bottom of the bag is provided with a pair of spaced apart parallel slits which define the side edges of a rectangular bottom fold portion or tab -22 after which the bottom end of the tube is formed into a diamond fold with tab 22 located at one end of the diamond fold and a triangular tab 30 located at the other end of the diamond fold as shown in FIG. 1. The diamond fold has a transverse center fold 17 and is formed to provide upwardly extending flaps 24 being formed in the center of the diamond fold. The outer faces of the flaps 24 are comprised of a portion of the outer sheet of bag 10 which has two ply thicknesses of each sealable lining 11 therebetween. Flaps 24 are united by a vertical fold 26 which is at the apex of a triangular bottom fold portion or tab 30 of the diamond fold whereby there will be no opening in this area when the bottom of the bag is sealed as will be described hereafter.

While the bottom of the bag 10 is being folded into the position shown in FIG. 1, heat is applied along strips at right angles to flaps 24 as shown by the arrows in FIG. 1. The centerline of this heat seal (known as the fin seal) is shown by dashed line 25 in FIG. 2. Heat is applied in an amount necessary to cause the opposing faces of the portion of lining 11 within flaps 24 to adhere to each other and thereby seal the entire length thereof. U.S. Pat. No. 2,846,928 discloses a method of applying the fin seal. Flaps 24 are then folded to the position shown in FIG. 2 and lie flush with the plane of the formed portion of the bag bottom.

Figure 2:
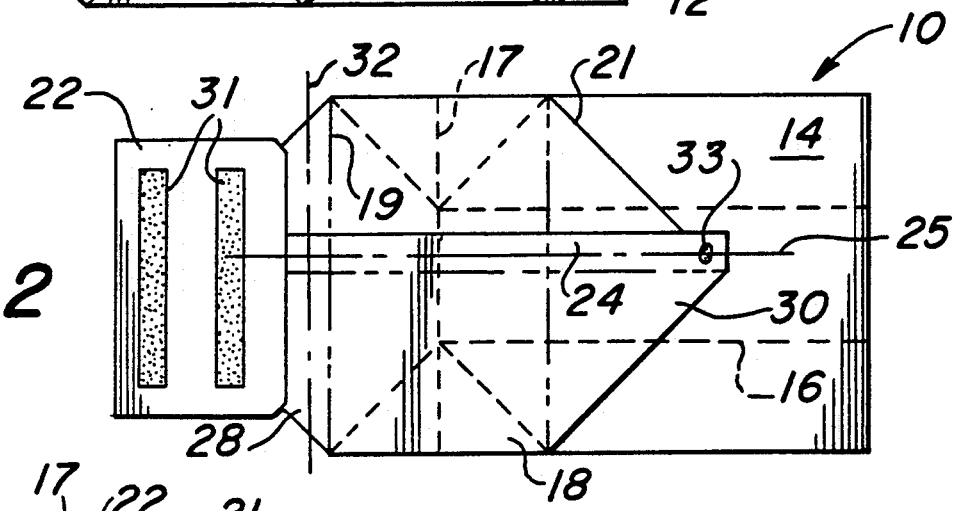

With the bag bottom in the condition shown in FIG. 2 of the Drawings, a heat seal is applied along a strip extending across the protruding tab portion 28 of the bag bottom. The centerline of this heat seal (known as the cross seal) is shown by dashed line 32 which intersects centerline 25 of the fin seal and is located between the tab 22 and the fold or crease line 19 upon which the final fold of this part of the bottom portion will be made.

The next step in the bag making procedure is to apply deposits of glue or adhesive to the bottom portion of the bag with the bag in the flattened condition as shown in FIG. 2. To this end, the rectangular tab 22 has deposited thereon two parallel spaced apart strips 31 of adhesive extending transversely thereacross in an arrangement as best shown in FIG. 2. Also, the triangular tab 30 has deposited thereon a small spot 33 of adhesive near the apex thereof.

Figure 3:
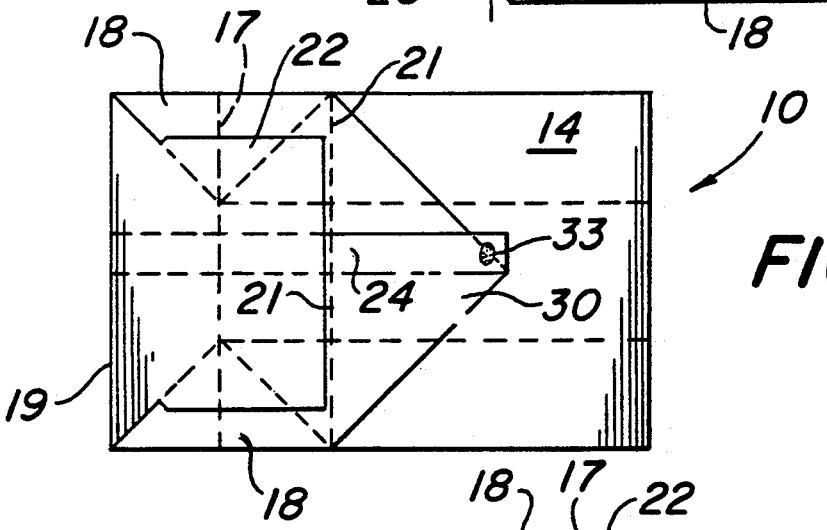

The next step is to fold the bag bottom along the fold or crease line 19 to the position shown in FIG. 3 wherein the rectangular tab 22 is folded over to lie across the bottom 18 of the bag in a flat condition. When this step is performed, the adhesive strips 31 come into adhering contact with the bottom 18 to attach the tab 22 to the bottom and secure the same in the flat position as shown in FIG. 3.

Figure 4:
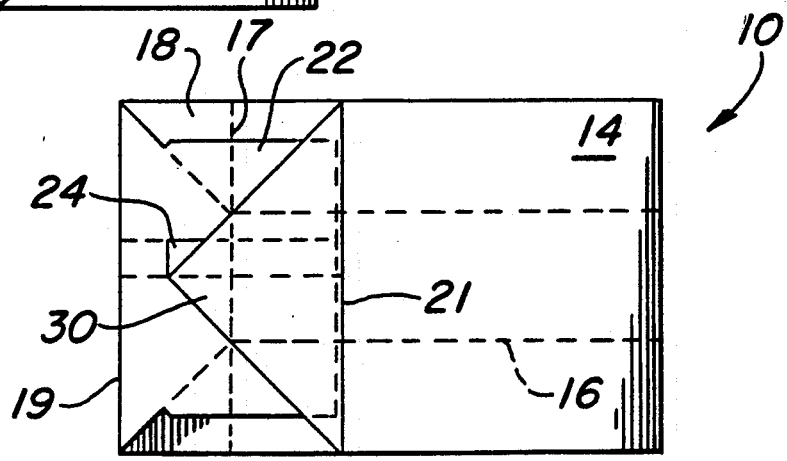

The next step is to fold over the triangular tab 30 of the diamond folded bottom along the fold or crease line 21 to the position as shown in FIG. 4. During this step, the triangular tab 30 is pressed into contact on top of rectangular tab 22 so that the adhesive spot 33 adheres the tab portion 30 onto the tab portion 22 in overlapping relation by reason of the adhesive contact provided thereby. This completes the formation of the bag bottom.

It will be noted that the bag construction as shown in FIG. 4 is such that the rectangular tab portion 22 is caused to adhere to the bottom 18 of the bag by reason of the adhesive strips 31 applied in the position as shown in FIG. 2. Also, the triangular tab 30 of the bag bottom structure is secured in the flat position as shown in FIG. 4 by reason of its attachment to the rectangular tab 22 by means of the adhesive spot 33. It will thus be apparent that the adhesive spot 33 comprises a quantity of adhesive located in adhering relationship between the contiguous faces of the overlapping tab 30 and the overlapped tab 22. In accordance with the invention, the adhesive used for the adhesive spot 33 is made of a suitable pressure sensitive adhesive of any type well known in the art which is responsive to the occurrence of an elevated temperature to lose a sufficient amount of its adhesive properties to allow the triangular tab 30 to separate and move away from the bag bottom and to separate from its adhering relationship with the overlapped tab 22 in response to a force applied thereto urging the same away from the overlapped tab 22. The occurrence of such a force will- be produced during a microwave cooking operation as will be described hereafter. While various adhesives will be satisfactory and known to those skilled in the art, one suitable type are the commercially available polyvinyl acetate-based pressure sensitive adhesives.

In FIG. 5, the bag 10 is shown in a condition whereby it is ready to be used in a microwave cooking application, with the contents thereof being popcorn kernels. In this case, the popcorn kernels have been inserted into the interior of the bag through an open top end, after which the top end of the bag is heat sealed along a seal line indicated at 50 in FIG. 5. Thus, FIG. 5 shows a package adapted for the microwave cooking of popcorn and comprising a bag 10 in accordance with this invention containing a quantity of popcorn kernels. While the invention will be described with respect to the cooking of popcorn, it will be apparent that it will be adaptable for the microwave cooking of any expandable type product.

In the use of the bag in accordance with the invention for the microwave cooking of popcorn, the bag 10, as shown in FIG. 5, is placed in a microwave oven for a full cooking cycle. As the corn kernels heat up and begin to pop, the gas pressure within the bag builds up because of the expansion of the gases therein as the cooking operation proceeds. Also, as the temperature of the bottom of the bag 10 rises, the adhesive deposit 33 begins to lose its adhesive properties and the triangular tab 30 which is urged away from the bag bottom by reason of the passage of gas into the interior thereof, releases from the bottom and begins to expand along with the bag itself. This partially expanded condition is shown in FIG. 6.

As the corn kernels continue to pop and the gases within the bag continue to expand, the bag 10 itself expands completely to the position shown in FIG. 7 with the triangular tab 30 extending from the bag bottom 18 to form a fin-like extension.

The presence of a fin extension as described above appears to improve the efficiency of the microwave cooking operation. This is apparently the result of the fact that the fin extension increases the volume of the bag itself as compared to a bag without a fin extension, which appears to have some positive effect on the efficiency of the microwave cooking operation.

As will be apparent from a consideration of FIG. 8 and other figures of the drawings, the triangular tab 30 defines a triangular-shaped internal chamber which communicates with the interior of the bag since there is no seal other than the fin seal centered on line 25 at the outer end of the triangular tab 30. Thus, at the base of the triangular tab 30 at fold line 21, the gases can pass into the chamber within the triangular tab 30 from the bottom of the bag which also communicates with the interior of the bag as there is no seal preventing such communication.

It will also be apparent that the tabs 22 and 30 form bottom fold portions that are folded over along parallel spaced part fold lines 19 and 21, respectively, which fold lines 19 and 21 form the side edges of the rectangular bottom 18.

What is claimed is:

1. In a bag of the gusseted square-bottom type having a generally rectangular bottom formed by a diamond fold having at its ends a pair of bottom fold portions, said bottom fold portions being folded over along parallel spaced apart fold lines forming side edges of the bag bottom, the portion of the diamond fold between said fold lines being rectangular, said bottom fold portions being constructed to overlap one another in the folded condition thereof, the outer bottom fold portion being adhesively secured to the inner bottom fold portion between the opposed faces of the overlapping regions, the improvement comprising:

said inner bottom fold portion having a generally rectangular configuration and being sealed adjacent said fold line thereof, and said outer fold portion having a generally triangular configuration and being sealed at its outer most ends to define an inner enclosed space which communicates with the interior of the bag, said adhesive securing said outer bag bottom fold portion to said inner bottom fold portion being responsive to the occurrence of an elevated temperature thereof to lose at least some of its adhesive properties whereby said outer bottom fold portion can move away from the bag bottom to break the attachment thereto in response to a force applied to said outer bottom fold portion as a result of gases flowing from the interior of the bag into said inner enclosed space within said outer bottom fold portion.

2. In a bag of the gusseted square-bottom type having a generally rectangular bottom including a pair of bottom fold portions folded over to extend along a portion of the bag bottom with one of said bottom fold portions being arranged to overlap the other in the folded condition thereof forming the bag bottom, the improvement comprising:

said overlapped bottom fold portion being secured to the bag bottom in a flat folded condition by a first adhesive means, said overlapping bottom fold portion being sealed at peripheral portions to define an inner enclosed space that communicates with the interior of the bag and being secured to the bag bottom in a flat folded condition by a second adhesive means, said second adhesive means comprising a quantity of adhesive located in adhering relationship between the contiguous faces of the overlapping bottom fold portion and the overlapped bottom fold portion, said quantity of adhesive of said second adhering means being responsive to the occurrence of an elevated temperature thereof to lose a sufficient amount of its adhesive properties to permit said overlapping bottom fold portion to move away from the bag bottom and to separate from its adhering relationship with said overlapped bottom fold portion in response to a force applied to said overlapping bottom fold portion urging the same away from said overlapped bottom fold portion as a result of gases flowing from the interior of the bag into enclosed space.

3. A bag according to claim 2 wherein said overlapped bottom fold portion has a generally rectangular configuration and said overlapping bottom fold portion has a generally triangular configuration, said bottom fold portions being formed as opposite tabs of a diamond fold at the bag bottom.

4. In a bag of the gusseted square-bottom type having a generally rectangular bottom including a pair of bottom fold portions folded over to extend along the bag bottom, the improvement comprising:

means for maintaining one of said bottom fold portions to extend along the bag bottom in a flat folded condition, the other of said bottom fold portions being sealed at peripheral portions to define an inner enclosed space communicating with the interior of the bag, means for maintaining the other of said bottom fold portions to extend along the bag bottom is a flat folded condition including a quantity of adhesive located in adhering relation between the other bottom fold portion and a part of the bag bottom, said quantity of adhesive being responsive to the occurrence of an elevated temperature thereof to lose at least some of its adhesive properties whereby said other bottom fold portion can move away from the bag bottom in response to a separating force applied to said other bottom fold portion as a result of gases flowing from the interior of the bag into said inner enclosed space.

5. A bag according to claim 4 wherein said one bottom fold portion has a generally rectangular configuration and said other bottom fold portion has a generally triangular configuration, said bottom fold portions being formed as opposite tabs of a diamond fold at the bag bottom.

* * * * *